United States Patent [19]

Hall

[11] Patent Number: 5,018,581

[45] Date of Patent: May 28, 1991

[54] SAND RELEASE APPARATUS AND METHOD

[76] Inventor: L. D. Hall, 2647 Cos, Liberty, Tex. 77575

[21] Appl. No.: 536,317

[22] Filed: Jun. 11, 1990

[51] Int. Cl.[5] ..... E21B 23/00; E21B 34/14; E21B 43/00

[52] U.S. Cl. ..... 166/373; 166/68; 166/317; 166/386; 166/105

[58] Field of Search ..... 166/317, 105, 105.1, 166/105.2, 68, 373, 386

[56] References Cited

U.S. PATENT DOCUMENTS 2,626,177 1/1953 Maxwell et al. ..... 166/317 X 4,103,739 8/1978 Hall ..... 166/105

4,359,094 11/1982 Risinger ..... 166/317

*Primary Examiner*—Stephen J. Novosad

*Attorney, Agent, or Firm*—Gunn, Lee & Miller

[57] ABSTRACT

An apparatus and method are disclosed which are utilized in oil wells incorporating a reciprocating pump. The improvement is for the situation where the typical sand release apparatus has failed to clear a sand lock. The disclosed apparatus is such that the rotation of the two telescoping sleeves relative to each other is restricted thereby allowing the tool string to be unthreaded at a reverse thread at the top of the sand release apparatus. In this way, the apparatus allows removal of the tool string above the location where the tool is locked through rotation in a direction opposite of that normally used to unthread tool strings.

19 Claims, 1 Drawing Sheet

SAND RELEASE APPARATUS AND METHOD

BACKGROUND OF THE DISCLOSURE

The present invention is an improvement of the apparatus disclosed in U.S. Pat. No. 4,103,739.

Typically during oil production, a pump will be required at some stage to lift the oil from the well. The pumps are utilized to produce oil from low pressure formations. These pumps are normally inserted into the tubing string inside the production casing and are located near the producing zone. The casing string is typically perforated to allow the formation fluid to flow from the surrounding formation into the casing. The tubing string is open at the bottom to allow fluid to enter. The materials produced are typically a mixture of oil, water, and sand in varying ratios. The pump is utilized to incrementally lift the materials produced from the formation up the tubing string to where it is collected at the surface.

The housing of the pump leaves a space between the outer surface of the pump and the inner surface of the tubing string. This annular space collects sand from the sand bearing mixture after pulling the liquid through the pump housing for delivery through the pump tubing. During the time that the mixture stands between the pump and the tubing string, the difference in the specific gravity of the sand particles and the water/oil mixture causes significant settling of the sand particles. This sand collects and builds up around the lower portion of the pump housing and connected string and clogs the space above the pump supporting nipple or in shoulder which holds the pump. This sand build up normally does not interfere with the pump action or the lifting of the mixture produced from the formation.

Periodically all pumps utilized for lifting the oil/water mixture to the surface need to be serviced. To service these pumps, it is essential that the sucker rods and pump be lifted from the well and serviced at the surface. One problem that periodically occurs is that the sand build up around the housing of the pump and locks the pump in place thereby preventing removal of the pump and sucker rods.

U.S. Pat. No. 4,103,739 discloses an apparatus which extends to allow the sand collected around the pump housing to wash through slotted openings thereby clearing the annular space around the pump. While that apparatus has proved to be successful in freeing the pump most of the time, on occasion the pump still cannot be removed. The present invention is an apparatus to allow tool removal in those situations. The present invention is connected to the lower portion of a production pump. It is primarily a pair of telescoping members that conforms in size and shape to the typical production pump. The apparatus is prevented from telescoping by shear pins which normally maintain the apparatus in the non-extended or pumping position. While in this position, the drain slots are not exposed and the pump operates in a normal fashion. When removing the pump and connected sucker rods, the load on the shear pins for removal of the pump is an acceptable and known load assuming the pump is not sand locked. The shearing force required for the shear pins is in excess of that amount of pull. During typical pump removal, the shear pins are not sheared and the telescoping members remain in the closed condition without extending. This allows normal removal of the pump and sucker rods.

On the other hand, if the pump is sand locked, the present invention comes into play. The innermost sleeve member is initially threaded to the pump hold down which rests on the inwardly protruding shoulder of the tubing string. The outermost sleeve member is connected by a left-hand thread to a double male threaded coupling or adapter which is in turn threaded to the lower portion of the pump apparatus. Movement of the two sleeve members is prevented by one or more selectively sized shear pins. The innermost tubular member has a surrounding and protruding lip at the upper end which is sufficiently large to lock it against pulling through the outer tubular member. If the pump is sand locked, the normal pull is exceeded until the upward pull breaks the shear pins which join the telescoped tubular members. When the shear pins are broken, the outer tubular member slides upwardly to expose a set of drain slots which are adjacent to the sand locking the pump. The hydrostatic pressure of the fluid column above the sand washes the sand down through the slots and then through the center of the tool and out through the bottom. Typically, this washing action will free the sand locked pump. Occasionally, this washing action is insufficient, and the pump remains sand locked. At this time, the improvements of the present apparatus are required to free the sand locked pump.

In addition to the first set of shear pins discussed above, a second set of one or more pins extends through the outer sleeve member to pass through the drain slots while in the non-extended position. The length of the drain slots is sufficient such that the second set of pins do not restrict the telescoping movement of the present invention. The purpose of the second set of pins is to prevent rotational movement of the sleeves with respect to each other.

As was previously noted, the outermost sleeve member is attached to a double male threaded coupling or adapter through the use of left handed threads. In the situation where the pump is still sand locked after the first shear pins are sheared and the flushing action has taken place, the sucker rods and pump are rotated to the right unthreading the left handed thread connection between the present apparatus and the bottom of the pump. Once rotated sufficiently, the rods and pump can be separated from the present apparatus, pulled up the well and brought to the surface.

SUMMARY OF THE INVENTION

The apparatus of the present invention can be adapted to fit pre-existing pumps or can be included in newly manufactured pumps. The apparatus allows removal of pumps which have become sand locked through collection of sand around the pump joined to the sucker rods. If the pump becomes sand locked, an increased axial pull during attempted removal shears a set of shear pins to free telescoped members and expose a set of drain slots. Normally, the sand washing past the tool through the drain slots frees the pump. On the other hand, in those situations when the pump is still sand locked, the additional set of pins restricts rotational movement between the sleeves. This allows the sucker rods and pump to be rotated so that the rods and pump are disconnected from the apparatus by unthreading a left hand threaded adapter between the apparatus and the pump. The use of this apparatus allows pumps which remain sand locked after telescoping and flushing to be removed from the well and brought to the surface.

BRIEF DESCRIPTION OF THE DRAWINGS

So that the manner in which the above recited features, advantages and objects of the present invention are attained and can be understood in detail, a more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may admit to other equally effective embodiments.

DESCRIPTION OF THE PREFERRED EMBODIMENT

Figure 1:
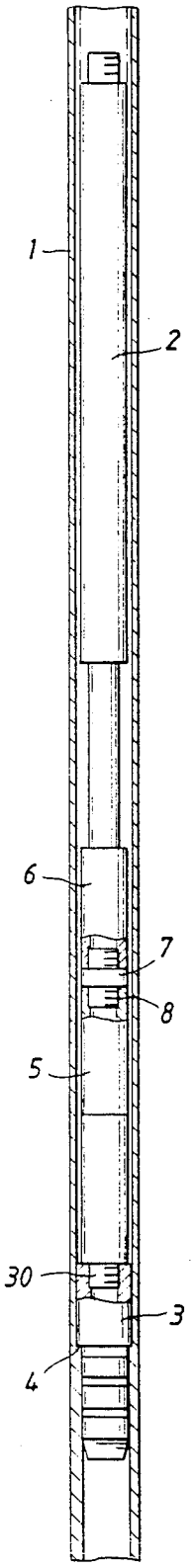
FIG. 1 is a sectional view through the tubing string showing the present invention installed between the pump and pump hold down.

In FIG. 1, the tubing string is indicated by the numeral 1. The pump is generally indicated by the numeral 2. The pump 2 is positioned within the tubing string 1. The pump is anchored through the use of a pump hold down 3 which rests on a shoulder 4 included in the tubing string 1. The pump 2 is attached to a string of sucker rods which extend to the surface where they are connected to a walking beam mechanism. The present invention is thus intended to be equipment installed on the lower portion 6 of a pre-existing pump or installed with newly manufactured pumps below the pump 2 and above the pump hold down 3. The sand release apparatus 5 is shown in the form of a tubular member threaded below the pump 2 and above the pump hold down 3.

Figure 2:
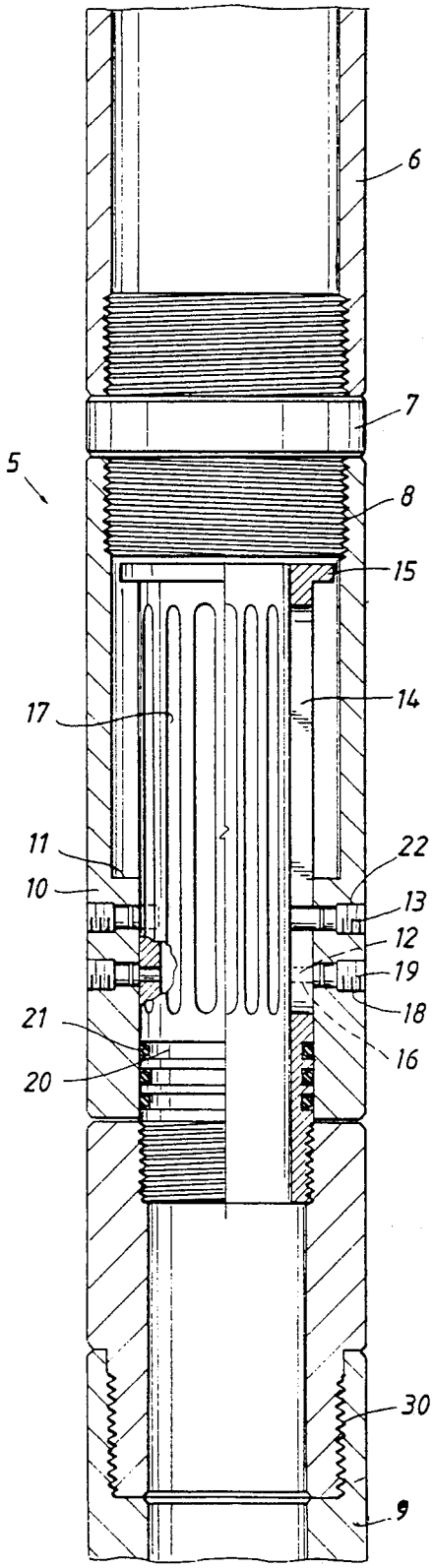
FIG. 2 is a sectional view through the pump modified with the apparatus in accordance with the teachings of the present invention and showing the tubular sleeve members in the unextended position and joined by the shear pins.

Reference is made to FIG. 2 which shows the lower end 6 of the pump 2 which is threaded to a double male thread coupling 7 which is in turn threaded to the present invention 5 through the means of left handed threads 8. Normally, the threads in a tubing string are made in the opposite hand. During routine operations, rotation in the opposite hand tightens the standard threaded connection while the left hand thread 8 will unthread, a virtue noted below. The lower portion of the apparatus is also threaded at 30 to the upper portion 9 of the pump anchor. While it is possible for the apparatus 5 to be joined to or formed integrally through the omission of the threads 30 between the apparatus 5 and the pump hold down 3, the left handed thread connection 8 at the lower end of the double male thread coupling enables disconnection of the pump and sucker rods from the present apparatus. The outer tubular sleeve member 10 is threaded to the coupling 7. The sleeve 10 supports an inwardly protruding shoulder 11. The sleeve 10 has multiple threaded radial openings 18 and 22 with mating multiple plugs 19 and rotation restricting pins 13 joined thereto. An inner tubular sleeve 14 supports at one end an outwardly protruding lip 15 to cooperatively lock against the shoulder 11 to thereby prevent the inner sleeve 14 from pulling through the outer sleeve 10. Additionally, the sleeve 14 has a set of openings 16 to receive a set of shear pins 12. In addition, the sleeve 14 has a set of slots 17 to receive the rotation restricting pins 13. The shear pins 12 are attached to the plugs 19 and threaded to the outer sleeve 10 to position the pins 12 in the openings 16 to prevent extension of the sleeve 14 with respect to the sleeve 10. The number of pins 13 is normally two to six while the shear pins number about two to six. The aggregate strength and cross section of the shear pins is a design factor relating to the pull necessary to break them.

At a location along the portion of the sleeve 14 exposed during telescoping movement, a set of slots 17 is formed. Several slots are positioned around the sleeve 14. It is preferred that the many slots are fairly long. They have a width which is more than adequate to enable the sand laden mixture to flow through the slots during the flushing procedure. This shape is not mandatory for all slots. The slots could also be a set of circular openings or openings of any other selected shape and number. The slots 17 must receive the pins 13 so that the rotation restricting pins 13 extend into the sleeve 14 through the extended drain slots 17. Several drain slots must be long enough to ensure that the rotation restricting pins extending thereinto do not restrict relative telescoping movement.

The numeral 18 identifies tapped openings formed in the side wall of the tubular sleeve 10 to threadably engage threaded plugs 19 supporting protruding shear pins 12. These protruding shear pins 12 extend from the tapped openings 18 into matching openings 16 in the inner tubular sleeve 14. The shear pins join the two tubular members 10 and 14 together to prevent telescoping movement. When the the tubular members are joined, the slots 17 are not exposed. The numeral 22 identifies tapped openings formed in the side wall of the tubular sleeve 10 to engage the threaded rotation restricting pins 13. The restricting pins 13 are long enough to protrude into the slots 17 of the inner sleeve 14. The tubular sleeve 14 is smooth on the exterior except one or more encircling grooves 20 and sealing O-rings 21 are located in the grooves. Typically three sets of grooves and rings are utilized for proper sealing. These seals prevent unintended leakage between sleeve 14 and sleeve 10 while in the non-extended position.

Figure 3:
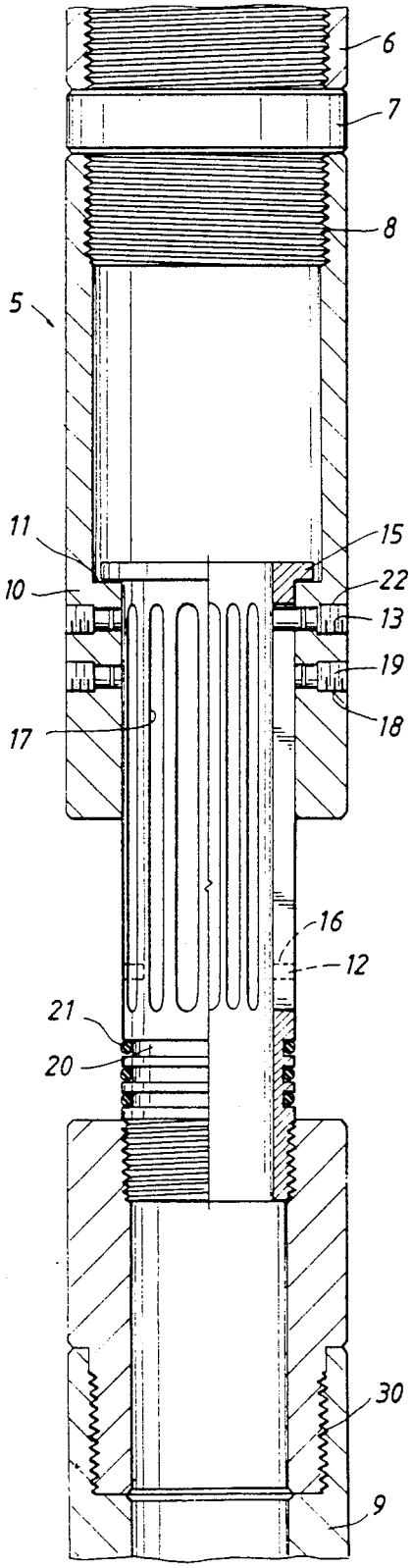
FIG. 3 is a view similar to FIG. 2 except that the apparatus is shown in the extended position after the shearing action had taken place.

When the apparatus is in the extended configuration shown in FIG. 3, the slots 17 are exposed for draining the sand locking the tool in place. The hydrostatic pressure above the sand forces the sand through the slots 17 and axially down through the inside of the tool 5. In this way, the sand washes through the interior of the apparatus and moves past the pump hold down 3. When in the extended position, the rotation restricting pins 13 still extend through the inner sleeve member 14 and prevent rotation of the outer sleeve 10 with respect to the inner sleeve 14 by cooperatively engaging the elongated slots 17. This feature becomes important when the flushing action is insufficient to free the pump from the sand lock.

Should the flushing action be insufficient to free the sand locked pump, pump 2 and sucker rods are rotated in a clockwise or right hand direction at the surface thus unthreading the pump 2 from the invention 5 at the left hand threads 8. While the pump 2 is rotated clockwise, the apparatus is held in place by the pump hold down 3, and the rotation restricting pins 13 prevent movement of the outer sleeve portion 10. In this manner, the outer sleeve member 10 is held fixed during rotation of the pump 2. Because sucker rods and pumps are typically connected using right hand threads, the right hand or clockwise rotation results in the unthreading only at the left hand threads 8. In this manner, the pump is disconnected from the apparatus 5 and the pump hold down 3 at a location above the sand lock.

The apparatus 5 operates in the following manner. It is typically installed at the lower end of a typical pump between the lower portion 6 of the pump and the pump hold down 3. Alternatively, the apparatus may be installed during manufacture and assembly of the pump 40. In this embodiment, the apparatus 5 can be permanently fixed to the pump hold down in lieu of being threadably connected. During normal operation of the pump, the apparatus 5 is not utilized. Additionally, should the pump not be sand locked, the device 5 is not utilized during removal. The apparatus 5 comes into play only when the pump is sand locked. When locking occurs, and an increased axial pull is applied to free the lower end of the pump sand locked into the tubing string, the shear pins 12 break to allow the telescoping movement of the apparatus 5. In the typical situation, the hydrostatic pressure on the locking sand forces the sand through the slots 17, thereby clearing the annular space of the sand. Occasionally, this flushing action is insufficient to free the pump 2 from the sand. At this time, the additional set of pins and the left hand thread become helpful for unsticking. Because pumps are normally connected using right hand threads, the single left handed thread connection 8 allows the sucker rods and pump to be rotated to the right or clockwise for unthreading at the left handed threads 8. To prevent rotation between the inner sleeve member 14 and the outer sleeve member 10, the rotation restricting pins 13 cooperatively engage the upper end of the extended drain slots 17 and prevent relative rotational movement. In this manner, the lower end of the tool string, namely, the pump hold down 3 and sleeves 10 and 14 of the apparatus are fixed during the rotation by the restricting pins, thereby allowing unthreading at the left handed threads 8 during the right hand or clockwise rotation.

The foregoing disclosure is directed to the preferred embodiment which is shown as separable component. It is also possible to integrally construct the pump apparatus. Many modifications and alterations can be incorporated in the apparatus but the scope thereof is determined by the claims which follow:

What is claimed is:

1. A sand release apparatus for enabling the release of a pump comprising:

(a) first and second telescoped tubular sleeves adapted to be joined to a pump to form an elongate tubular extension thereof, wherein said first sleeve is affixed to the lower portion of the pump and said second sleeve is affixed to a pump hold down below the pump, said sleeves being initially closed and wherein said telescoped sleeves axially extend to an elongated arrangement;

(b) a first restricting means for restricting relative axial extension of said tubular sleeves, said means restricting axial extension until an axial pull thereon exceeds a specified level;

(c) sleeve located drain opening means said opening means being exposed upon axial extending telescoping movement to thereby drain sand around the exterior of the pump and apparatus through said opening means into the interior of the apparatus and downwardly through the lower portions thereof and wherein said sleeves close said drain opening means when said sleeves are telescoped together; and (d) rotation restricting means for limiting relative rotational movement between said sleeves after axial extension thereof.

2. The apparatus of claim 1 including a seal means below said drain opening means for sealing against flow through said drain opening means prior to axial extension by telescoping movement.

3. The apparatus of claim 1 wherein said rotation restricting means comprises one or more pins extending through said second sleeve and cooperatively engaging said drain opening means to restrict rotational movement of said sleeves relative to each other.

4. The apparatus of claim 3 including a set of left hand threads cooperatively engaging a threaded coupling to allow removal of the pump from the well through right hand rotation of the sucker rods and pump.

5. The apparatus of claim 2 wherein said seal means comprises one or more seals to seal the space between the first and second tubular sleeves.

6. The apparatus of claim 5 wherein said first restricting means is one or more shear pins received in appropriately aligned openings formed in the first and second sleeves.

7. The apparatus of claim 6 including a second travel restricting means comprising an outwardly protruding lip on the first sleeve and inwardly protruding shoulder on the second sleeve, said shoulder and lip cooperatively engaging each other for limiting telescoping axial movement of said sleeves.

8. The apparatus of claim 1 including a set of left hand threads cooperatively engaging a threaded coupling to allow removal of the pump from the well through right hand rotation of the tubing string.

9. The apparatus of claim 8 wherein said first restricting means is one or more shear pins received in appropriately aligned openings formed in the first and second sleeves.

10. The apparatus of claim 9 including a second travel restricting means comprising an outwardly protruding lip on the first sleeve and inwardly protruding shoulder on the second sleeve, said shoulder and lip cooperatively engaging each other for limiting telescoping axial movement of said sleeves.

11. A sand release apparatus for enabling the release of a pump comprising:

(a) first and second telescoped tubular sleeves adapted to be joined to a pump to form an elongate tubular extension thereof, wherein said first sleeve is affixed to the lower portion of the pump and said second sleeve is affixed to a pump hold down below the pump, said sleeves being initially closed and wherein said telescoped sleeves axially extend to an elongated arrangement;

(b) a first restricting means for restricting relative axial extension of said tubular sleeves, said means restricting axial extension until an axial pull thereon exceeds a specified level;

(c) sleeve located drain opening means said opening means being exposed upon axial extending telescoping movement to thereby drain sand around the exterior of the pump and apparatus through said opening means into the interior of the apparatus and downwardly through the lower portions thereof and wherein said sleeves close said drain opening means when said sleeves are telescoped together; and (d) means for enabling controlled separation of the pump from the apparatus at a specified joint, and while said apparatus is downhole and locked in place.

12. The apparatus of claim 11 including one or more rotation restricting pins extending through said second sleeve and cooperatively engaging said drain opening means to restrict rotational movement of said sleeves relative to each other.

13. The apparatus of claim 12 including seal means which comprise one or more seals to seal the space between the first and second tubular sleeves.

14. The apparatus of claim 13 wherein said first restricting means is one or more shear pins received in appropriately aligned openings formed in the first and second sleeves.

15. The apparatus of claim 14 including a second restricting means comprising an outwardly protruding lip on the first sleeve and inwardly protruding shoulder on the second sleeve, said shoulder and lip cooperatively engaging each other for limiting telescoping axial movement of said sleeves.

16. The apparatus of claim 11 wherein said means enabling separation comprises a set of left hand threads cooperatively engaging a threaded coupling to allow removal of the pump from the well through right hand rotation of the sucker rods and pump.

17. The apparatus of claim 16 including one or more rotation restricting pins extending through said second sleeve and cooperatively engaging said drain opening means to restrict rotational movement of said sleeves relative to each other.

18. A method for releasing a pump determined to be sand locked comprising the sequential steps of:

(a) applying an upward force on the sucker rod string to break a shear pin restricting relative axial extension of telescoped sleeve members connected in the well below the pump;

(b) extending said telescoped sleeve members to expose drain openings to permit sand to flow away from the annular space; and (c) disconnecting from the tubing string below the pump to pull the pump free of the sand locked condition.

19. The method according to claim 18 wherein said disconnecting step includes the sub-steps of:

(a) restricting relative rotational movement of said sleeves; and (b) rotating the sucker rod string to the right for unthreading until disconnection occurs.

* * * * *